US005752556A

United States Patent [19]

Steadman

[11] Patent Number: 5,752,556

[45] Date of Patent: May 19, 1998

[54] SUPPORT ARRANGEMENT

[76] Inventor: William David Steadman, 111-4800 SE. Federal Hwy., Stuart, Fla. 34997

[21] Appl. No.: 694,631

[22] Filed: Aug. 7, 1996

[51] Int. Cl.[6] ..... E04F 10/00

[52] U.S. Cl. ..... 160/78; 160/79; 160/80; 160/70; 160/71; 135/88.1

[58] Field of Search ..... 160/66, 67, 70, 160/71, 78, 79, 80, 22; 248/286.1, 276.1, 354.1, 354.5; 135/88.1, 88.18, 88.12, 25.1

[56] References Cited

U.S. PATENT DOCUMENTS

| | | | |
|---|---|---|---|
| 500,741 | 7/1893 | Giessenbier | 160/78 |
| 1,410,987 | 3/1922 | Bennett | 160/78 |
| 3,789,903 | 2/1974 | Clark et al. | 135/88.12 |
| 4,160,458 | 7/1979 | Marcellus | 160/67 X |
| 4,253,689 | 3/1981 | McKee | 160/67 X |
| 4,508,126 | 4/1985 | Everard | 160/67 X |
| 4,658,877 | 4/1987 | Quinn | 160/67 X |
| 4,759,396 | 7/1988 | Quinn | 160/22 X |
| 4,819,706 | 4/1989 | Quinn | 160/67 |
| 4,932,620 | 6/1990 | Foy | 248/276.1 X |
| 5,148,848 | 9/1992 | Murray et al. | 160/67 |
| 5,172,743 | 12/1992 | Wallace et al. | 160/67 |
| 5,174,352 | 12/1992 | Murray et al. | 160/67 |
| 5,558,145 | 9/1996 | Baka | 160/67 |

*Primary Examiner*—Daniel P. Stodola
*Assistant Examiner*—Bruce A. Lev
*Attorney, Agent, or Firm*—Watts, Hoffmann, Fisher & Heinke Co., L.P.A.

[57] ABSTRACT

A support arrangement (12) for mounting an awning or similar on a wall (14). The arrangement (12) includes a first elongate member (18) one end of which is pivotally mountable on the wall (14). The other end of the member (18) pivotally mounts a shorter second member (28). A third elongate member (32) is provided slidably mounted to the second member (28) and lockable to the first member (18) when in a parallel relationship therewith. The end of the member (32) away from the member (18) is pivotally mountable to an awning (10). By virtue of the respective sliding, pivotting and locking of the members (18.28.32), the arrangement (12) can adopt a collapsed position with the members (18.28.32) lying against each other such that the awning (10) can lie against the wall (14), or an erect condition with the members (18.28.32) in alignment and adjustable in length to provide for different inclinations of the awning (10).

29 Claims, 4 Drawing Sheets

SUPPORT ARRANGEMENT

FIELD OF THE INVENTION

This invention concerns a support assembly, particularly but not exclusively a support assembly usable with an awning or shutter to enable the awning or shutter to selectively cover a window or other opening, or to extend outwardly above the window or opening to act as a sun blind; and an awning, or shutter incorporating such an arrangement or arrangements.

BACKGROUND OF THE INVENTION

Conventionally apparatus for supporting awnings or shutters comprises a telescopic arm which requires removing from the awning/shutter and/or the wall when the awning/shutter is lowered. Such arrangements comprise fastening means such as nuts and bolts and perhaps also a locking bolt on the telescopic arrangement. These often become jammed or rusted up, particularly if they have not been used for some time but have been exposed to the elements. In areas which encounter extreme weather conditions such)as hurricanes, tornadoes or strong gales, it may be required to close awnings/shutters quickly once a weather warning has been received. If the support arrangements have become jammed etc. it would not be possible to quickly close the awning or shutter. Such arrangements also often do not permit ready lowering and raising of the awning/shutter; adjustment of the awning/shutter when raised; and/or tidy storage of the arrangement when the awning/shutter is lowered.

SUMMARY OF THE INVENTION

According to the present invention there is provided a support arrangement, the arrangement comprising a first elongate member mountable at one end to a fixture or article, a second member pivotally mounted to the first member at or adjacent the other end thereof, and a third elongate member slidably mounted the second member, and mountable on one end to a fixture or article.

The arrangement is preferably selectively movable between a collapsed condition with the second member pivoted through substantially 180° relative to the first member, and an erect condition with the first, second and third members in a generally parallel alignment.

Means are preferably provided for selectively preventing the sliding of the third member relative to the second member, with said members in required relative positions. The sliding preventing means may comprise engagement means selectively engageable between the first and third members. The arrangement may be such that the engagement means is only operable when the arrangement is in an erect condition.

The engagement means may comprise one or more sprung members selectively locatable in holes, and the or each sprung member may be provided on the third member and be engageable with respective ones of a plurality of holes in the first member. Locking means may be provided to retain the or each sprung member in a one of the holes.

Alternatively the engagement means may comprise a fixed projection locatable in respective openings or recesses.

The arrangement is preferably formed such that when in the erect condition, the third member is slidable relative to the first member. The first member preferably comprises a length of channel section through which the third member is slidable. The second member preferably comprises a piece of channel section through which the third member is slidable. The channel section of the second member is preferably shaped such that the third member is only slidably movable relative thereto, and the sides of the channel may have inwardly facing flanges to retain the third member in the channel.

The third member may also comprise a length of channel section. One or more sprung members of the engagement means are preferably provided within the channel of the third member, and are sprung outwardly to selectively extend laterally therefrom to be engageable in holes in the side walls of the first member. Preferably two sprung members are provided extending through opposite sides of the first member. The locking means preferably comprises a member engageable with the or each sprung member to prevent same from fully retracting into the third member. The locking member may be pivotally mounted to the third member to be movable between a locked position substantially parallel to the third member, and an inclined position where the or each sprung member is freely movable.

The arrangement may comprise a bracket for pivotally mounting said one end of the first member to a fixture. Said one end of the third member is preferably pivotally mountable to an article. A further bracket may be provided for selectively mounting said one end of the third member to the said fixture when the arrangement is in a collapsed condition. The further bracket may accept said one end of the third member in a spring fit, and a formation may be provided on the third member engageable with the further bracket.

The invention also provides an awning or shutter comprising a support arrangement according to any of the preceding eight paragraphs.

Preferably a plurality of such support arrangements are provided. Preferably an upper end in use of the awning or shutter is pivotally mounted to a fixture, with the other end pivotally mounted to said one end of the or each third member, and said one end of the or each first member pivotally mounted to the fixture.

An embodiment of the present invention will now be described with reference to the accompanying drawings.

DESCRIPTION OF A PREFERRED EMBODIMENT OF THE INVENTION

Figure 2:
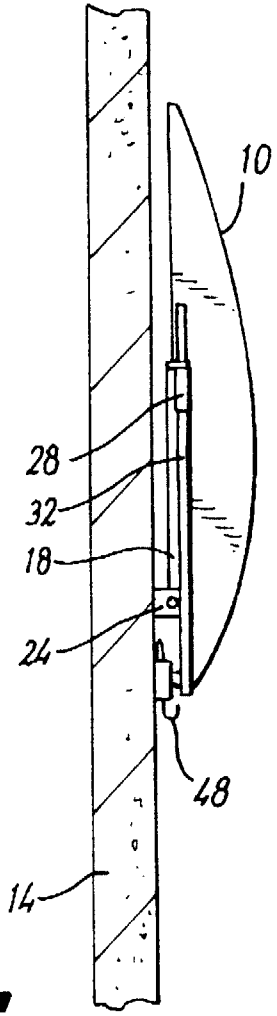
FIG. 2 is a diagrammatic side view of the assembly shown in FIG. 1, in a different condition.
Figure 1:
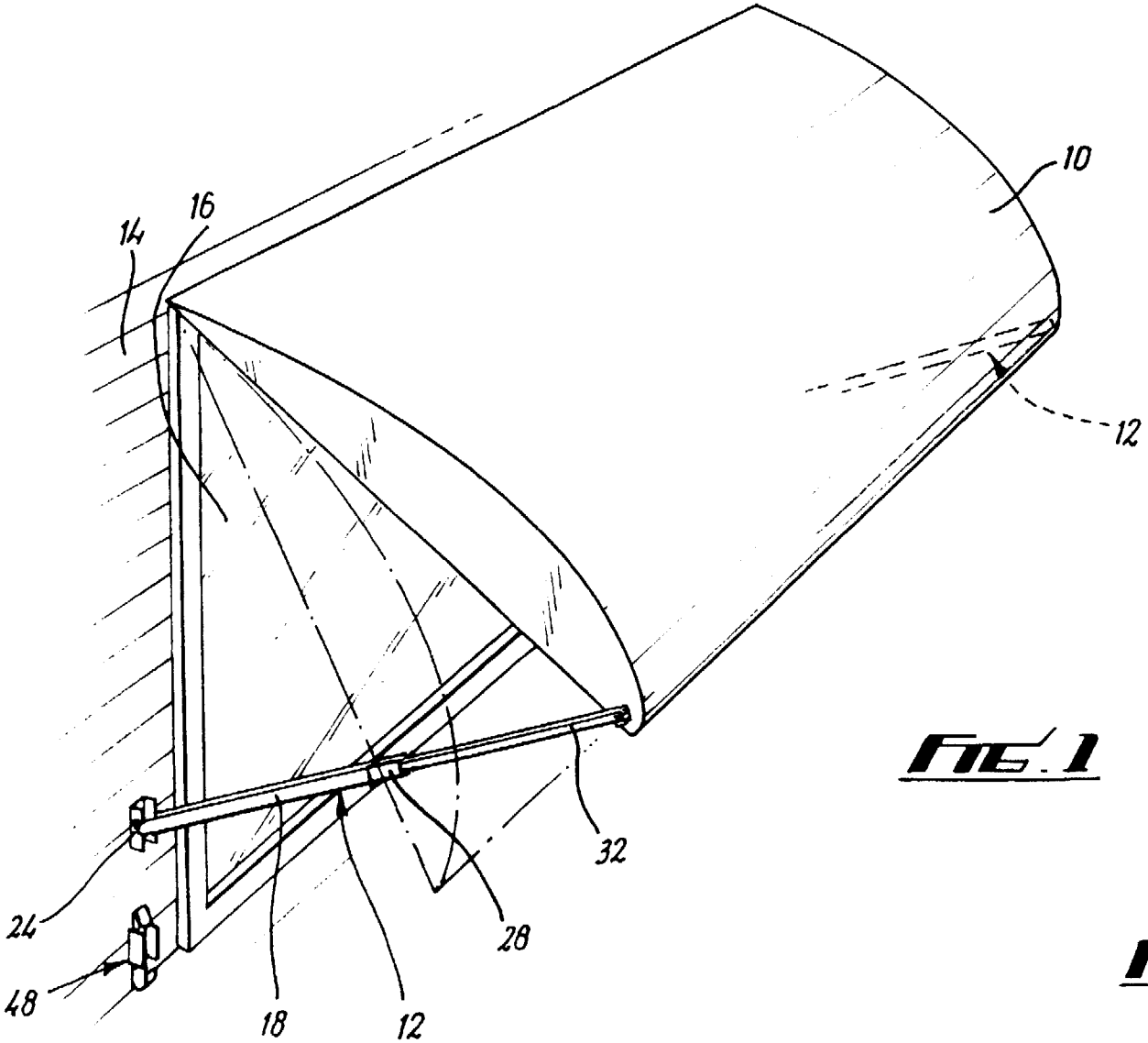
FIG. 1 is a diagrammatic perspective view of a support arrangement according to the invention in use with an awning.
Figure 3:
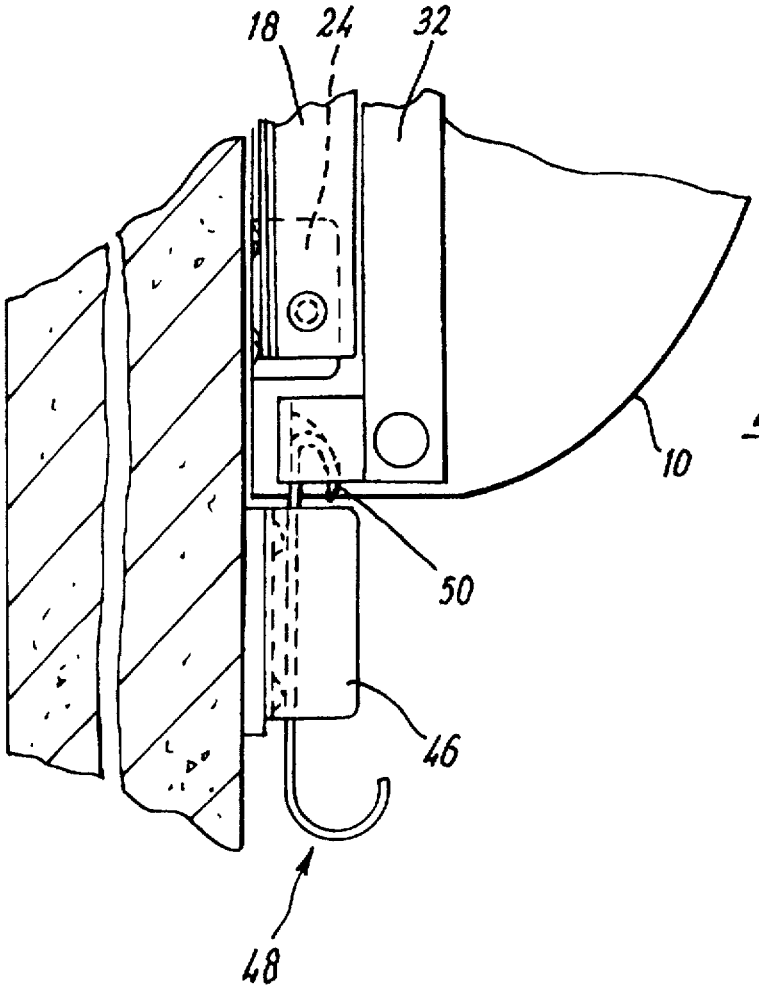
FIG. 3 is a diagrammatic side view of part of the assembly shown in FIG. 2.
Figure 4:
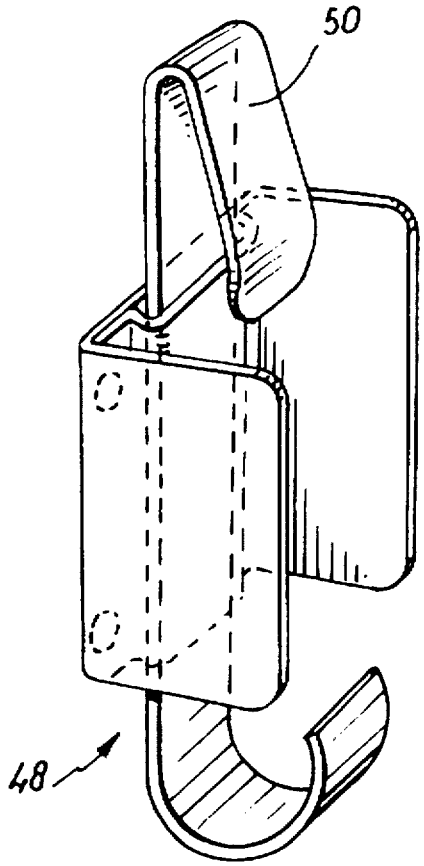
FIG. 4 is a perspective view of a component shown in FIG. 3.
Figure 5:
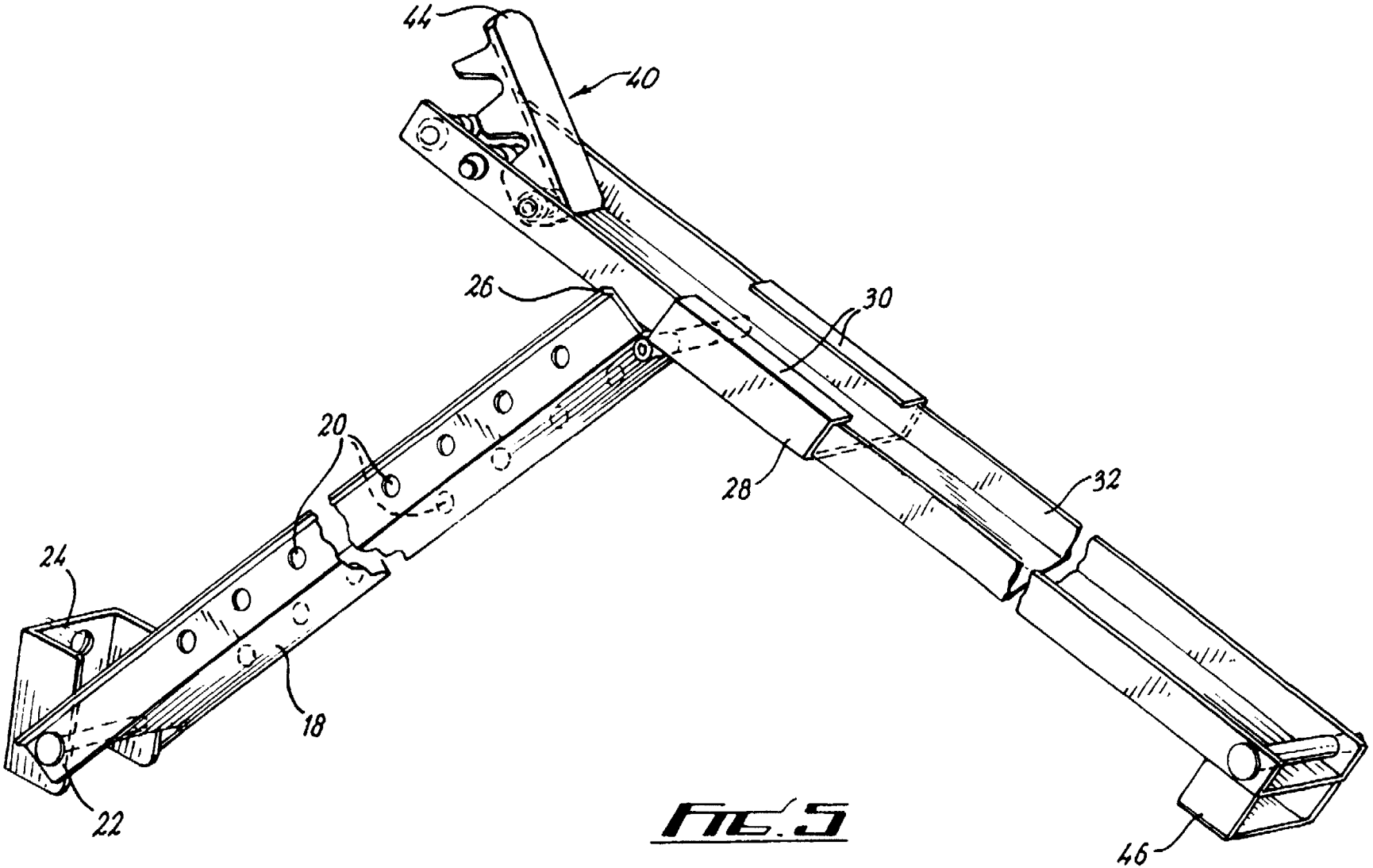
FIG. 5 is a diagrammatic perspective of part of the arrangement shown in FIG. 1.
Figure 7:
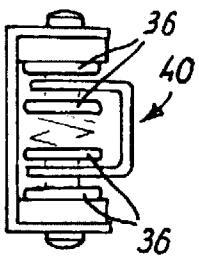
FIGS. 6, 7 and 8 are respective top, end and side views of part of the assembly shown in FIG. 5.
Figure 6:
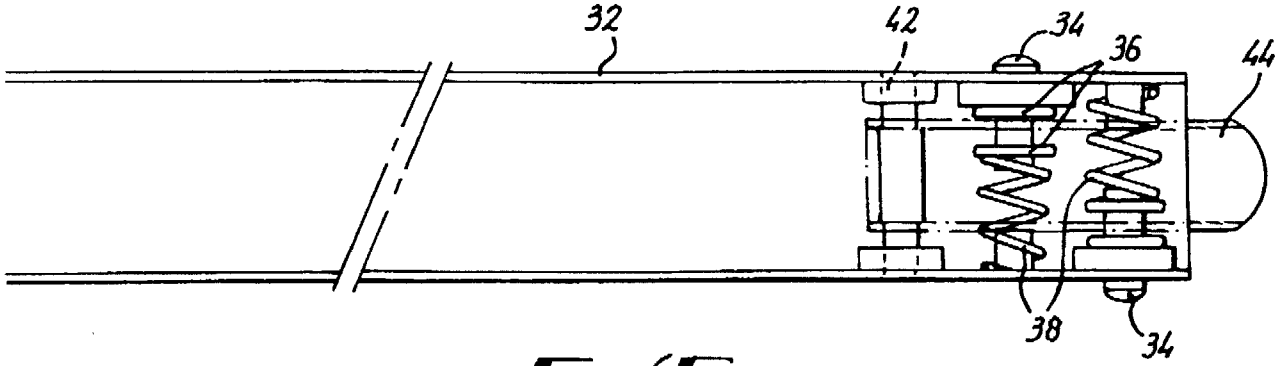
Figure 9:
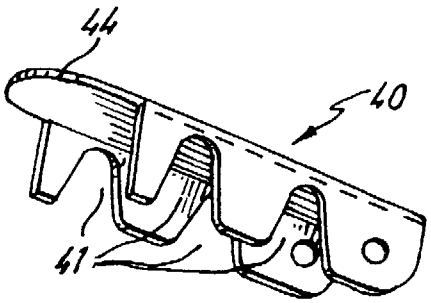
FIG. 9 is a diagrammatic perspective view of a component shown in FIGS. 6–8.
Figure 8:
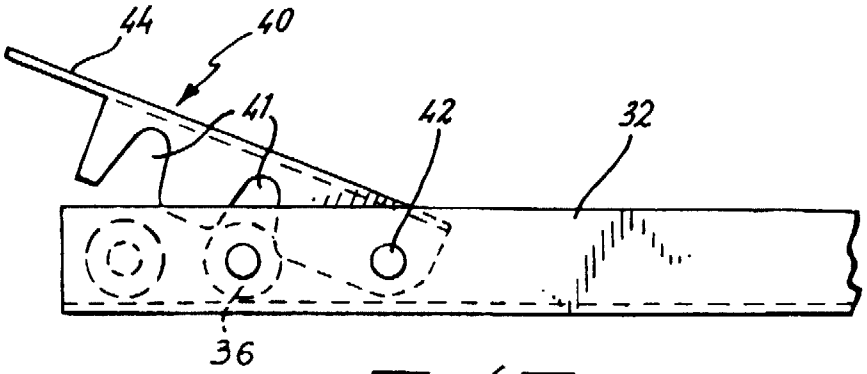

The drawings shown an awning 10 mounted by two support arrangements 12 on a wall 14 to selectively cover or provide a sun shade for a window 16. The arrangements 12 at each end of the awning 10 are identical and therefore only one such arrangement shall be described. The arrangements 12 permit the awning 10 to lie flat over the window 16 as shown in FIGS. 2 and 3 or to extend thereabove as shown in FIG. 1, with the inclination of the awning 10 being adjustable by virtue of the arrangements 12.

Each arrangement 12 comprises a first elongate member 18 of channel section. A plurality of holes 20 are provided through each of the side walls of the member 18. One end 22 of the member 18 is pivotally mounted to the wall 14 by a "U" shaped bracket 24.

The other end 26 of the member 18 pivotally mounts a second member 28. The second member 28 comprises a shorter length of channel section of the same width as that of the member 18 but with inwardly turned flanges 30 on the side walls thereof. Slidably extending through the second member 28 is a third elongate member 32 also of channel section.

Two sprung fingers 34 are provided in the channel section of the third member 32 towards the end thereof which points towards the first member 18. The fingers 34 are arranged side by side along the length of the member 32 to selectively laterally extend through opposite side walls of the third member. The fingers 34 each have a pair of bushes 36 thereon within the third member 32 and a compressed spring 38 extending between the innermost bush 36 and the opposite inner side wall of the third member 32. The outermost bush 36 prevents the fingers 34 extending beyond a certain amount from the member 32.

A locking member 40 also of channel section is provided. The member 40 is pivotally mounted within the third member 32 about a pivot 42 parallel to and adjacent the inner one of the fingers 34. The channel section of the member 40 faces into the channel of the third member 32 and two recesses 41 are provided in each of the side walls of the member 40 to accept each of the fingers 34, with a respective recess on each side engageable between the bushes 36 on a respective one of the fingers 34. A projection 44 is provided on the free end of the member 40 to aid manipulation thereof.

The other end of the third member 32 is pivotally mounted to the free end of the awning 10. A "U" shaped projection 46 is provided on the underside of the channel of the third member 32 adjacent said other end. A sprung bracket 48 is provided on the wall 14 beneath the bracket 24. The bracket 48 includes a sprung finger 50 locatable within the projection 46 when the latter is pushed therepast.

In use, with the awning 10 extending above the window 16 as a sun shade, the first, second and third members 18, 28 and 32 are in a parallel alignment. The distance between the end 22 and end of the member 32 pivotally mounted to the awning 10, can be varied, thereby varying the inclination of the awning 10. This variation in length is achieved by sliding the third member 32 relative to the first and second member 18, 28. The member 32 can be locked in position relative to the member 18 with the fingers 34 engaging in respective holes 20.

To move the member 32 relative to the member 18 the locking member 40 requires to be pivoted away from the fingers 34 which will automatically engage in respective holes 20 when in alignment. Once a required position is achieved, the member 40 is pivoted into the channel section of the third member 32 such that the fingers 34 locate in the recesses 41 but the side walls of the member 40 adjacent the respective recesses 41 abut against the bushes 36 preventing inward movement of the fingers 34. To move the member 32 relative to the member 18 the member 40 requires to be pivoted out of the member 32 and the fingers 34 can be pushed inwardly by hand.

To collapse the awning 10, the fingers 34 are removed from any of the holes 20, and the second member 28 and hence third member 32 are pivoted relative to the first member 18. The third member 32 is now freely slidably movable through the second member 28 and the awning can be lowered with the member 32 moving upwardly relative to the member 10 and pivoting further until it rests thereagainst as shown in FIGS. 2 and 3. The third member 32 can then be pressed against the bracket 48 such that the finger 50 engages in the projection 46.

There is thus described a support arrangement for an awning or similar, and also an awning incorporating such an arrangement which provides for considerable advantages over existing arrangements. The present arrangement does not include any fastening means which may become jammed or rusted. The arrangement may readily be operated without any tools and provides a strong support whether in an erect condition, or collapsed, when the arrangement is firmly secured to the wall. The arrangement is of relatively straightforward construction and can thus be inexpensively and robustly manufactured.

Various modifications may be made without departing from the scope of the invention. For example, rather than sprung fingers other engagement means could be provided such as a projection on the third member selectively engageable in one of a plurality of appropriately shaped openings or recesses in the first member. Any of the first, second and third members could be made other than from channel section. Different brackets could be provided for mounting the arrangement on a wall. Whilst the invention has been described in use with an awning, this arrangement could be used in a number of other situations such as with a shutter or other assemblies.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A support arrangement, said arrangement comprising:

a first elongate member with a one end and an other end;

means for mounting said one end of said first member to a fixture or article;

a second member;

means for pivotally mounting said second member to said first member at or adjacent said other end of said first member, a third elongate member with a one end and an other end;

means for slidably mounting said third member to said second member; means for mounting said one end of said third member to a fixture or article, and, said pivotal mounting being such that said arrangement is selectively movable between a collapsed condition with said second member pivoted through substantially 180° relative to said first member, and an erect condition with said first, second and third members in longitudinal alignment.

2. An arrangement according to claim 1, wherein means are provided for selectively preventing the sliding of said third member relative to said second member, with said members in required relative positions.

3. An arrangement according to claim 2, wherein said sliding preventing means comprises engagement means selectively engageable between said first and third members.

4. An arrangement according to claim 3, wherein said engagement means are formed to be only operable when said arrangement is in the erect condition.

5. An arrangement according to claim 3, wherein holes are provided in at least one of said first and said third members, and said engagement means comprises at least one biased member selectively locatable in said holes.

6. The arrangement of claim 5 wherein said holes are provided in both said first and said third members.

7. An arrangement according to claim 5, wherein at least certain of the holes are in said first member said at least one biased member is provided on said third member and is engageable with selected ones of a plurality of said holes in said first member.

8. An arrangement according to claim 7, wherein locking means are provided to retain said at least one biased member in a one of said certain holes in said first member.

9. An arrangement according to claim 8, wherein said locking means comprises a locking member engageable with each said at least one biased member to prevent same from fully retracting into said third member.

10. An arrangement according to claim 9, wherein means are provided for pivotally mounting said locking member to said third member, such that said locking member is movable between a locked position substantially parallel to said third member, and an inclined position where each said at least one biased member is freely movable.

11. An arrangement according to claim 7, wherein said third member comprises a length of channel section, said at least one sprung member of said engagement means being within the channel of said third member, and each said at least one biased member is biased outwardly by a spring means to selectively extend laterally from said third member to be engageable in said certain holes in said first member.

12. An arrangement according to claim 11, wherein said certain holes are in opposite sides of said first member and two said biased members are provided extending through selected ones of said certain holes in the opposite sides of said first member.

13. An arrangement according to claim 3, wherein said engagement means comprises a fixed projection locatable in respective spaces defined by a selected one of said first and third members.

14. An arrangement according to claim 1, wherein said slidable mounting means is formed such that when said arrangement is in the erect condition, said third member is slidable relative to said first member.

15. An arrangement according to claim 14, wherein said first member comprises a length of channel section through which said third member is slidable.

16. An arrangement according to claim 15, wherein said second member comprises a piece of channel section through which said third member is slidable.

17. An arrangement according to claim 16, wherein said channel section of said second member is shaped such that said third member is only slidably movable relative thereto.

18. An arrangement according to claim 17, wherein the sides of said channel section of said second member have inwardly facing flanges to retain said third member in the channel of said channel section.

19. An arrangement according to claim 1, wherein said mounting means for said one end of said first member comprises a bracket with pivot means, for pivotally mounting said one end of said first member to a fixture.

20. An arrangement according to claim 1, wherein said mounting means for said one end of said third member provides pivotal mounting of said third member to an article when the arrangement is in use.

21. An arrangement according to claim 1, wherein a further bracket is provided for selectively mounting said one end of the said third member to a fixture when said arrangement is in a collapsed condition and in use.

22. An arrangement according to claim 21, wherein said further bracket comprises means to accept and retain said one end of said third member.

23. An arrangement according to claim 20, wherein a formation is provided on said third member, said formation being engageable with said further bracket.

24. An awning comprising a support arrangement, said arrangement comprising:

a first elongate member with a one end and an other end;

means for mounting said one end of said first member to a fixture or article;

a second member;

means for pivotally mounting said second member to said first member near said other end thereof, a third elongate member with a one end and an other end;

means for slidably mounting said third member to said second member;

means for mounting said one end of said third member to a fixture or article; and, said members being moveable through pivotal relative movement of the first or second members between a collapsed storage position and an extended awning support position with the members in longitudinal alignment.

25. An awning according to claim 24, wherein a plurality of said support arrangements are provided.

26. An awning according to claim 24, wherein said awning has an upper and an other end, and in use said upper end is pivotally mounted to a fixture, with said other end pivotally mounted to said one end of each said third member, and said one end of the or each said first member is pivotally mounted to the fixture.

27. A shutter comprising a support arrangement, said arrangement comprising:

a first elongate member with a one end and an other end;

means for mounting said one end of said first member to a fixture or article;

a second member;

means for pivotally mounting said second member to said first member near said other end thereof, a third elongate member with a one end and an other end;

means for slidably mounting said third member to said second member;

means for mounting said one end of said third member to a fixture or article; and, said members being moveable through pivotal relative movement of the first or second members between a collapsed storage position and an extended shutter support position with the members in longitudinal alignment.

28. A shutter according to claim 27, wherein a plurality of said support arrangements are provided.

29. A shutter according to claim 27, wherein said shutter has an upper end and an other end, and in use said upper end is pivotally mounted to a fixture, with said other end pivotally mounted to said one end of each said third member, and said one end of the or each said first member is pivotally mounted to the fixture.

* * * * *